US006015210A

United States Patent [19]

Kanematsu et al.

[11] Patent Number: 6,015,210

[45] Date of Patent: Jan. 18, 2000

[54] INK CONTAINER WITH TWO INK ABSORBING MEMBERS FOR CONTROLLING INK FLOW TO A RECORDING HEAD

[75] Inventors: Daigoro Kanematsu; Masanori Takenouchi; Naoji Otsuka, all of Yokohama; Toshihiko Ujita, Yamato; Kentaro Yano, Yokohama; Osamu Iwasaki, Tokyo, all of Japan

[73] Assignee: Canon Kabushiki Kaisha, Tokyo, Japan

[21] Appl. No.: 08/951,165

[22] Filed: Oct. 15, 1997

Related U.S. Application Data

[63] Continuation of application No. 08/342,044, Nov. 17, 1994, abandoned.

[30] Foreign Application Priority Data

Nov. 29, 1993 [JP] Japan ..... 5-298193
Jan. 25, 1994 [JP] Japan ..... 6-006597

[51] Int. Cl.[7] ..... B41J 2/175

[52] U.S. Cl. ..... 347/87

[58] Field of Search ..... 347/85, 86, 87

[56] References Cited

U.S. PATENT DOCUMENTS

| | | | |
|---|---|---|---|
| 5,138,344 | 8/1992 | Ujita . | |
| 5,155,502 | 10/1992 | Kimura et al. . | |
| 5,162,817 | 11/1992 | Tajika et al. . | |
| 5,182,581 | 1/1993 | Kashimura et al. . | |
| 5,237,342 | 8/1993 | Saikawa et al. . | |
| 5,365,262 | 11/1994 | Hattori et al. | 347/87 |
| 5,421,658 | 6/1995 | Suzuki et al. | 347/85 |
| 5,434,606 | 7/1995 | Hindagolla et al. | 347/45 |

FOREIGN PATENT DOCUMENTS

| | | | |
|---|---|---|---|
| 0 488 829 A2 | 6/1992 | European Pat. Off. | 347/87 |

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet head unit according to the present invention has an ink container which includes a plurality of absorbers and enables stable ink supply and reduces running cost. A volume Z of the absorber disposed near an ink supply port satisfies 3 V<Z<10 V, where V is the sum of a volume of a liquid passage, a volume of a common liquid chamber and a volume of the ink supply passage of the recording head.

23 Claims, 8 Drawing Sheets

INK CONTAINER WITH TWO INK ABSORBING MEMBERS FOR CONTROLLING INK FLOW TO A RECORDING HEAD

This application is a continuation of application Ser. No. 08/342,044 filed Nov. 17, 1994 now abandoned.

BACKGROUND OF THE INVENTION

1. Field of the Invention

The present invention relates to an ink container, and an ink jet head unit which includes the ink container. More particularly, the present invention pertains to an ink container which accommodates an absorber improved so that it assures stable ink supply, an ink jet unit employing such a container, and an ink jet apparatus in which can be mounted in such an ink jet unit.

2. Description of the Related Art

In recent years, ink jet head units in which an ink jet head portion and an ink tank portion are formed as one unit have been drawing attention as the recording unit employed in ink jet recording apparatuses. In such an ink jet head unit, the ink tank portion and a common liquid chamber of the head portion are coupled to each other through an ink supply passage. The ink supply passage is provided with a filter for trapping dust in the supplied ink.

In ink jet type recording, the fixing property of the ink attached to the recording paper is in general one element which determines the printing quality. Ink having a low surface tension fixes fast and does not spread readily, and therefore can be effectively utilized in ink jet recording apparatus, particularly, in color ink jet recording apparatus. However, ink having a low surface tension has a tendency to reduce the quality of printed characters. Particularly, application of black ink having a low surface tension is undesirable. Hence, it has been proposed to use a combination of black ink having a relatively high surface tension and inks of other colors having low surface tensions so as to obtain color images having an improved quality of black characters and no blur.

However, ink having a low surface tension readily bubbles, and the flow thereof is readily interrupted while flowing through the passage for ink supply. Accordingly, air may be taken into the ink tank of the ink jet recording head from a contact surface between the filter and the absorber, resulting in the generation of bubbles in the ink supply passage, the common liquid chamber or the liquid passage. Consequently, non-discharge of the ink may occur or discharge of the ink may be interrupted. Also, the amount of ink which can be used up from the ink tank may be reduced.

The following measures have been taken to improve ink supply properties.

(a) The average pore size of the absorber has been reduced stepwise toward the part of the ink supply passage.

(b) An absorber having a uniform average pore size is inserted into an ink tank whose inner diameter is reduced gradually toward the ink supply port so as to achieve apparent and gradual reduction in the average pore size of the absorber.

(c) A plurality of absorbers having different average pore sizes are employed so as to acheive gradual reduction in the average pore size of the absorber toward the ink supply port.

However, the structure itemized (a) is difficult and expensive to manufacture, and the use thereof in inexpensive ink jet head units is therefore difficult. In the structure itemized (b), since a reduction in the average pore size of the absorber in the ink tank toward the ink supply port is achieved when the absorber is inserted in the ink tank, the pore size may vary locally, making the density of the ink in the ink tank vary. This makes smooth flow of the ink in the absorber impossible, and makes the ink supply interrupted.

In the structure itemized (c), since an absorber having a small average pore size is employed, the amount of ink (ink gross) retained in the absorber is reduced.

In color recording which employs different inks, a plurality of inks having different surface tensions are contained in the ink tanks. In that case, if the average pipe (pore) diameter and wetting angle of the absorber with respect to the ink are equal in each ink tank, since the capillary force of the ink differs in each color, gas may be taken in from the contact surface between the filter and the absorber for the ink having a small capillary force when the inks of all the colors are sucked at the same time.

SUMMARY OF THE INVENTION

The present inventors intensively studied to solve the above-described problems, and found that excellent ink supply is enabled when a plurality of absorbers having average pore sizes of a predetermined range are accommodated in an ink tank and when the volume of the absorber provided at the ink supply port is in a predetermined range.

A primary object of the present invention is directed to an ink container for containing ink to be supplied to a recording head. The ink container accommodates therein a first absorber at an opening from which the ink is supplied to the recording head, and a second absorber at a portion other than the opening.

A second object of the present invention is directed to an ink jet unit which comprises a recording head; and an ink container for containing ink supplied to the recording head. The ink container accommodates therein a first absorber at an opening from which the ink is supplied to the recording head, and a second absorber at a portion other than the opening.

A third object of the present invention is directed to an ink jet apparatus which includes a carriage on which a recording head and an ink container for containing ink to be supplied to the recording head are mounted as one unit, and the ink container accommodates therein a first absorber at an opening from which the ink is supplied to the recording head and a second absorber at a portion other than the opening.

A volume Z of the first absorber and a sum V of a volume of a liquid passage, a volume of a common liquid chamber and a volume of an ink supply passage of the recording head, have a relationship expressed by $3\ V<Z<10\ V$.

In the present invention, a reduction in the amount of ink retained in the absorber is achieved, and the amount of ink which can be used up is increased to a maximum value. Further, since the taking in of gas during suction/recovery is prevented, the amount of ink of each color can be reduced to a minimum value, and the running cost of the ink jet recording head can be reduced.

DETAILED DESCRIPTION OF THE PREFERRED EMBODIMENTS

Recording Apparatus

Figure 5:
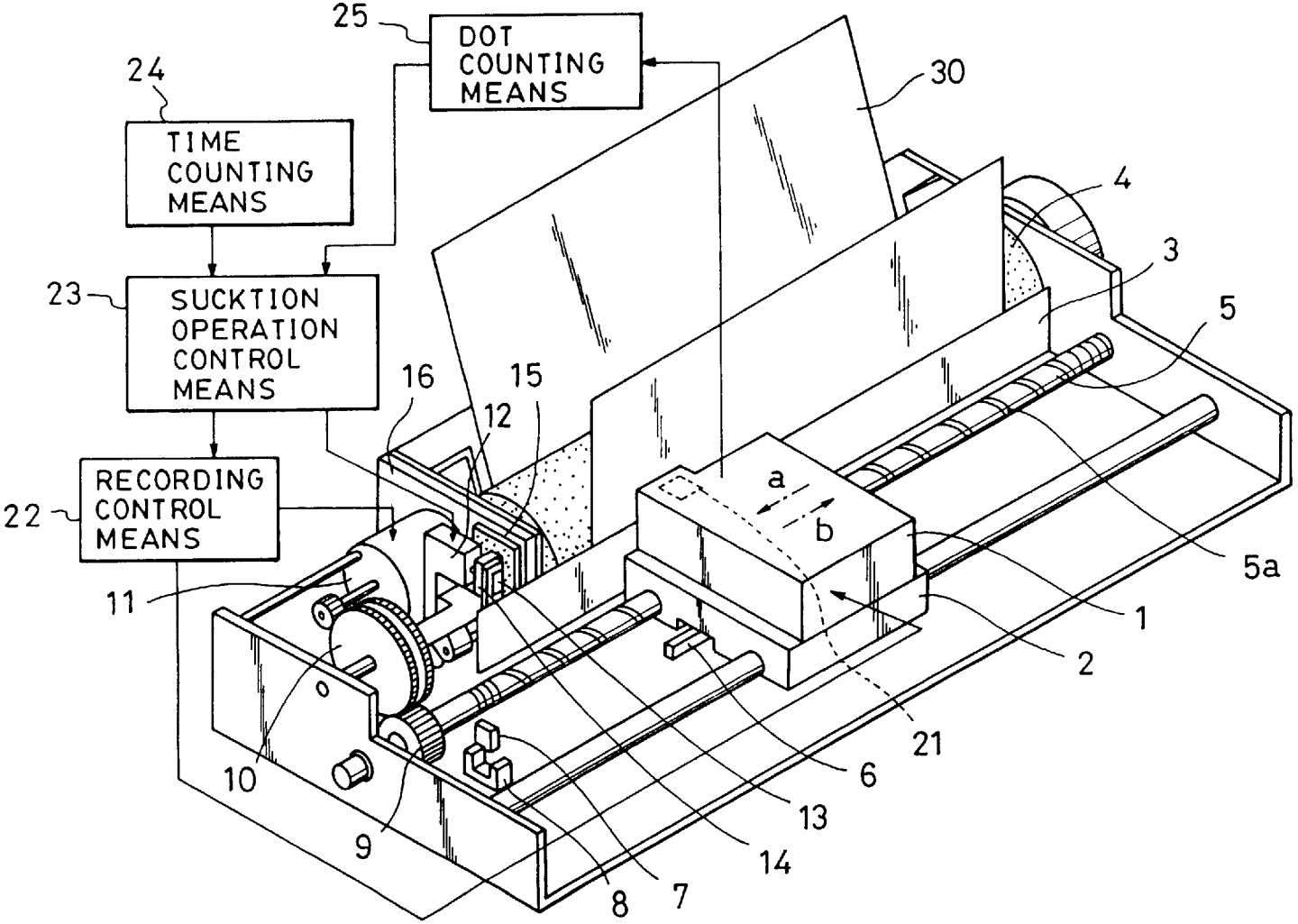
FIG. 5 is a schematic perspective view of an embodiment of an ink jet recording apparatus according to the present invention.

FIG. 5 is a schematic perspective view of an embodiment of an ink jet recording apparatus according to the present invention. As shown in FIG. 5, a carriage 2 is moved back and forth in directions indicated by arrows "a" and "b" by transmitting forward and backward rotations of a driving motor 11 to a lead screw 5 through two driving force transmission gears 9 and 10. The carriage 2 mounts thereon an ink jet cartridge 1 in which an ink tank (not shown) for accommodating ink for recording and a recording head (not shown) for discharging the ink toward a sheet of recording paper 30 are formed as one unit. A platen 4 for conveying the recording paper 30 is rotatably provided in such a manner that it opposes the ink jet cartridge 1. A paper pressing plate 3 presses the side of the recording paper 30 which opposes the ink jet cartridge 1 and retains the recording paper 30 in such a manner that the paper is separated from the ink jet cartridge by a predetermined interval. Recording control means 22 controls a recording operation of discharging ink from the recording head which is conducted while the carriage 2 is moved by the driving motor 11. A number of dots recorded in the recording operation is counted by dot counting means 25. The recording head of the ink jet cartridge 1 has a temperature sensor 21 for measuring the temperature of the recording head. A quantity of electricity output from the temperature sensor 21 is supplied to suction operation control means 23. The means for measuring the temperature of the recording head is not limited to the temperature sensor 21. Any means for measuring the temperature of the recording head can be employed. Such means can be mounted at any position on the ink jet recording apparatus. Two photo couplers 7 and 8 are provided on the left of the carriage 2 as viewed in FIG. 5. The photo couplers 7 and 8 are home position detection means for checking the presence of a lever 6 provided on the left end portion of the carriage 2 as viewed in FIG. 5 to switch over the direction of rotation of the driving motor 11. A cap member 13 is provided at a position which is outside the range where the ink jet cartridge 1 is reciprocatively moved during the recording operation but where the ink jet cartridge 1 is moved during suction operation. The cap member 13 is supported by a cap supporting member 14. The cap member 13 caps a front surface (a discharge port surface) of the recording head of the ink jet cartridge 1. When suction means 12 performs suction on the cap member 13 which is capping the recording head, viscous ink or bubbles in the recording head are removed, that is, a head recovery operation is conducted. A cleaning blade 15 is provided on the side of the cap member 13. The cleaning blade 15 is supported by a blade supporting member 16 in such a manner that it can protrude toward the ink jet cartridge 1 and thereby be brought into contact with the front surface of the recording head. The cleaning blade 15 is protruded into a moving path of the ink jet cartridge 1 after the suction operation and while the ink jet cartridge 1 is being moved back so as to wipe the front surface of the recording head. A cleaning blade having any other configurations can also be employed.

Recording Head

Figure 6:
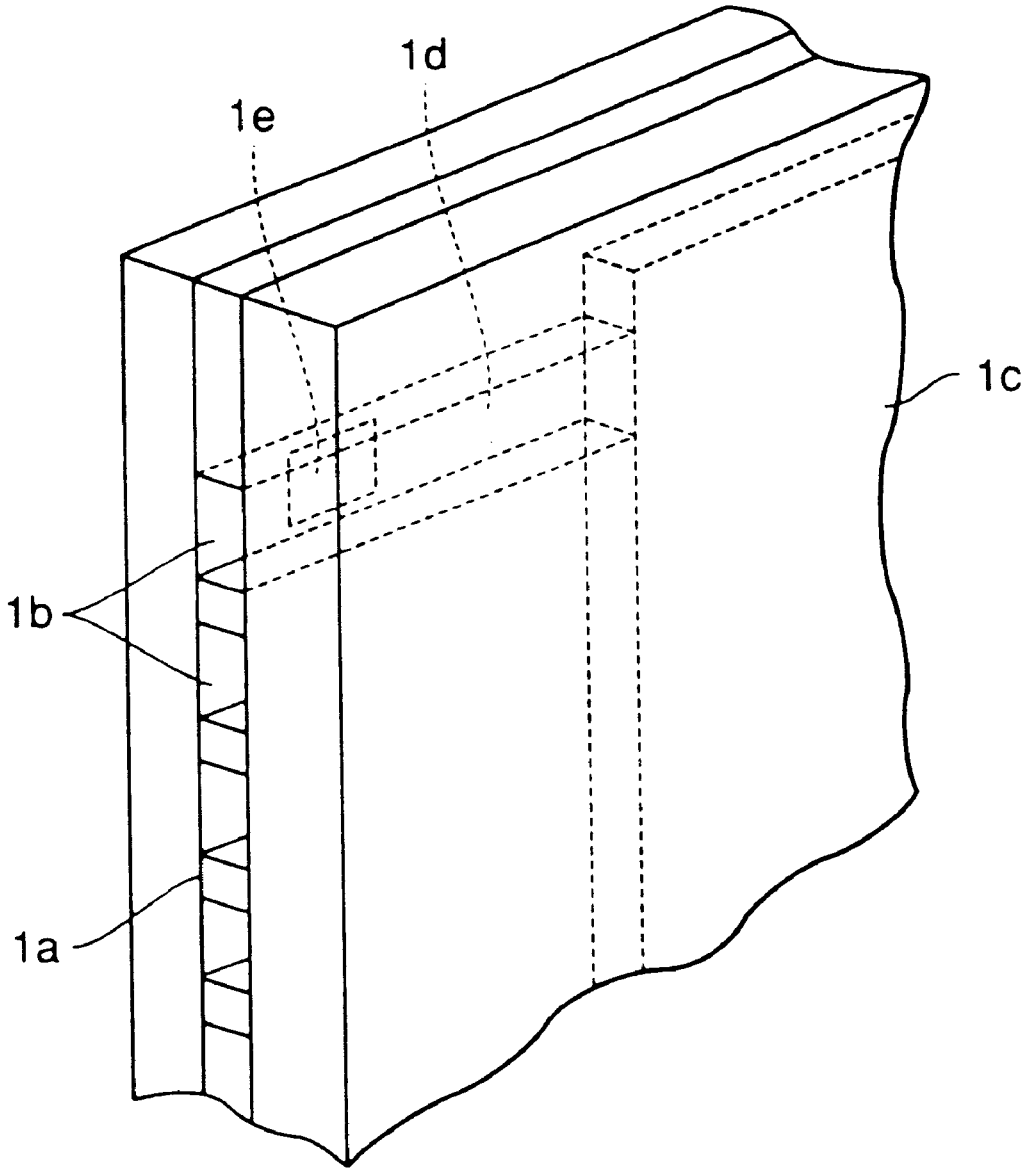
FIG. 6 is a perspective view of a recording head on an ink jet cartridge shown in FIG. 5.

The above-described recording head will now be described in detail with reference to FIG. 6. FIG. 6 is an enlarged perspective view of the essential part of the recording head of the ink jet cartridge shown in FIG. 5. In the recording head, a plurality of discharge ports 1*b* are formed at a predetermined pitch on a discharge port surface 1*a* which faces the recording paper 30 (see FIG. 5) with a predetermined gap therebetween, as shown in FIG. 6. An electrothermal transducer 1*e* for generating energy used for ink discharge is disposed along a wall surface of a liquid passage 1*d* which couples a common liquid chamber 1*c* to each of the discharge ports 1*b*. The common liquid chamber 1*c* communicates with the ink tank of the ink jet cartridge 1 (see FIG. 5) so that the ink can be supplied to the common liquid chamber 1*c* from the ink tank. The ink supplied from the ink tank is temporarily stored in the common liquid chamber 1*c*. The ink in the common liquid chamber 1*c* enters the liquid passage id due to capillary action, filling the liquid passage 1*d* and forming a meniscus at the discharge port 1*b*. At that time, if the electrothermal transducer 1*e* is energized through electrodes (not shown) and heated, the ink on the electrothermal transducer 1*e* is rapidly heated, generating a bubble in the liquid passage 1*d*. The ink is discharged from the discharge port 1*b* as a consequence of expansion of that bubble.

Control Structure

A control structure for controlling respective portions of the recording apparatus for recording will now be described with reference to FIG. 7. In a control circuit shown in FIG. 7, reference numeral 40 denotes an interface for inputting a recording signal. Reference numeral 41 denotes a MPU. Reference numeral 42 denotes a program ROM for storing a control program for executing the MPU 41. Reference numeral 43 denotes a dynamic RAM for storing various data (the above-described recording signal or recording data to be supplied to the head), a number of printing dots and a number of times the ink recording head has been replaced. Reference numeral 44 denotes a gate array for controlling supply of recording data to the recording head as well as transfer of data between an interface 40, the MPU 41 and the RAM 43. Reference numeral 50 denotes a carrier motor for conveying the ink jet cartridge 1. Reference numeral 49 denotes a convey motor for conveying the recording paper. Reference numeral 45 denotes a head driver for driving the head. Reference numerals 46 and 47 respectively denote motor drivers for driving the convey motor 49 and the carrier motor 50.

Figure 7:
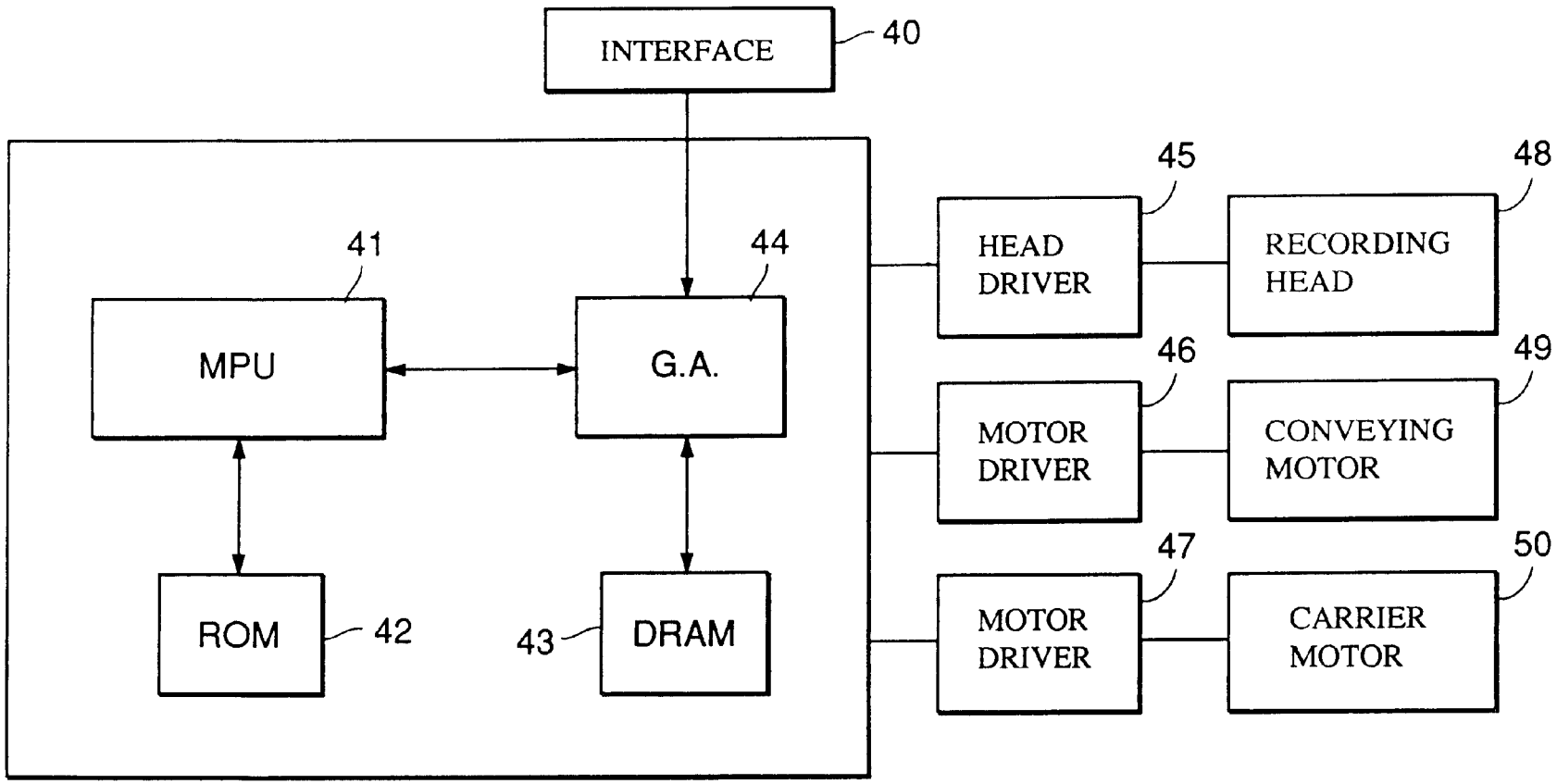
FIG. 7 is a block diagram showing the control structure of portions of the ink jet recording apparatus according to the present invention.
Figure 8:
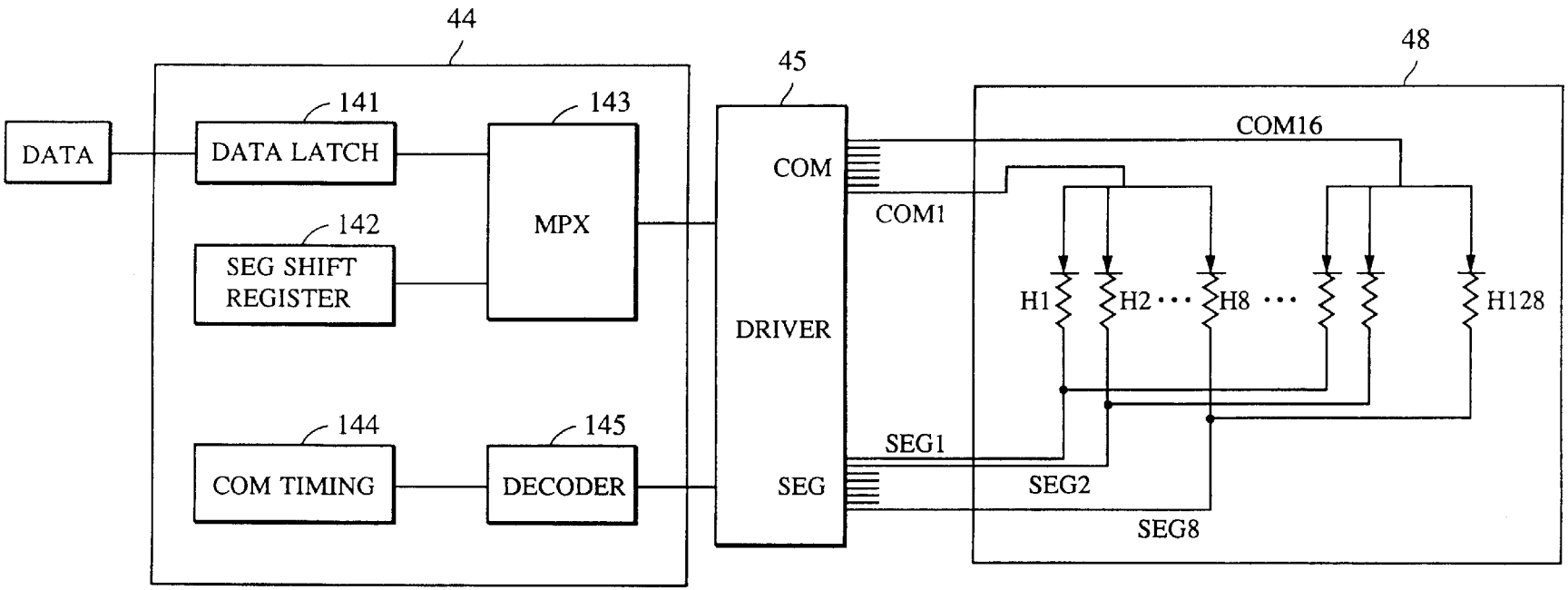
FIG. 8 is circuit diagram showing the detail of the respective portions shown in FIG. 7.

FIG. 8 is a circuit diagram, showing in detail the respective portions shown in FIG. 7. The gate array 44 has a data latch 141, a segment (SEG) shift register 142, a multiplexer (MPX) 143, a common (COM) timing generating circuit 144, and a decoder 145. A recording head 48 has a diode matrix configuration in which a driving current flows in any of discharge heaters (Hi to H128) where a common signal COM coincides with a segment signal SEG so as to allow the ink to be heated and discharged.

The decoder 145 decodes the timing generated by the common timing generating circuit 144 so as to select one of the common signals COM 1 through 8. The data latch 141 latches the recording data read from the RAM 43 in 8 bits. The multiplexer 143 outputs the recording data as segment signals SEG 1 through 8 according to the contents of the segment shift register 142. The output of the multiplexer 143 varies between 1-bit data, 2-bit data and 8-bit data, depending on the contents of the shift register 142.

The above-described control structure will be operated in the manner described below: when a recording signal enters the interface 40, it is converted into recording data to be printed between the gate array 44 and the MPU 41. Thereafter, the motor drivers 46 and 47 are driven, and the recording head is driven for printing according to the recording data sent to the head driver 45.

First Embodiment

Figure 1:
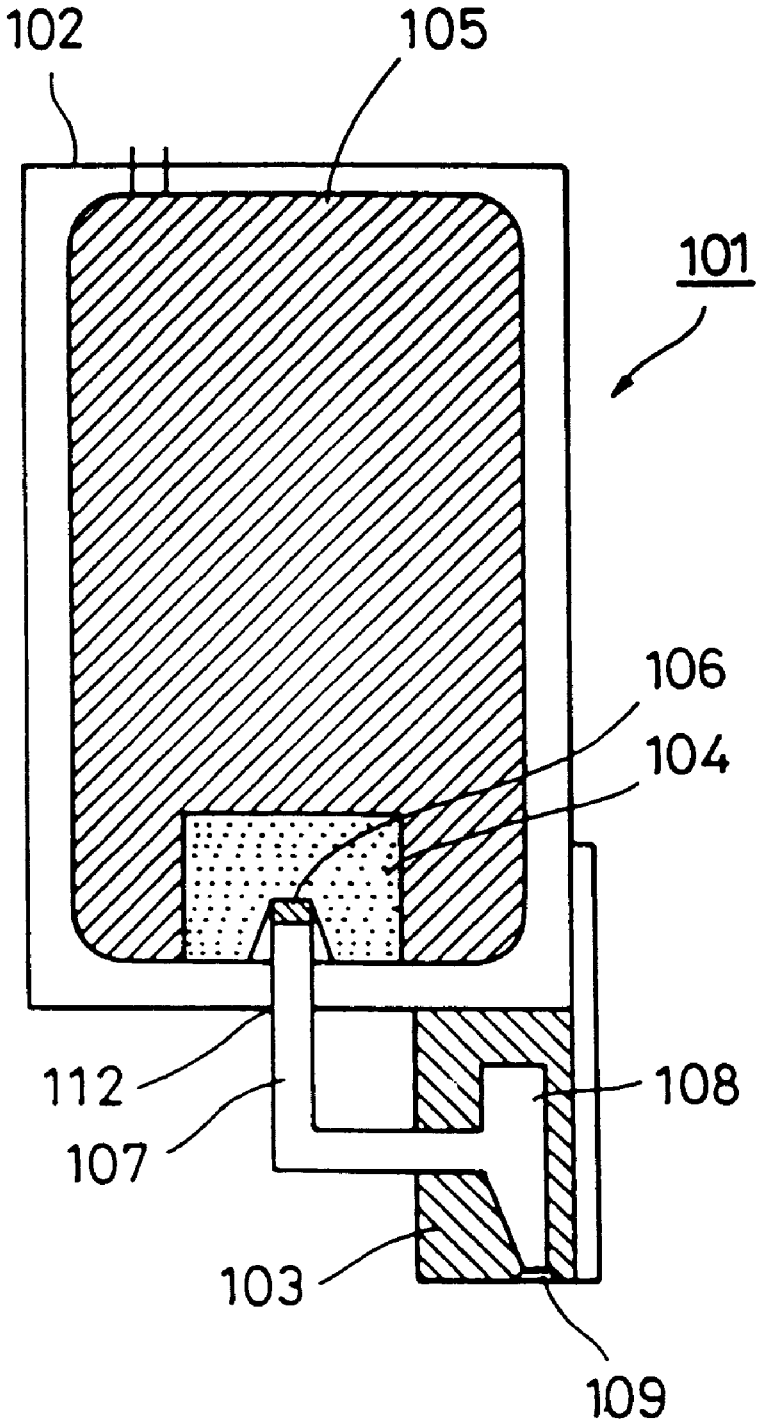
FIG. 1a schematic view of an embodiment of an ink jet unit according to the present invention.

FIG. 1 is a cross-sectional view of an ink jet unit 101 to which the present invention is applied.

A head 103 and an ink tank 102 are coupled to each other through an ink supply pipe 107 constituting the ink supply passage to the head 103. The ink supply pipe 107 is inserted into an ink supply port 112 of the ink tank 102.

The ink tank 102 accommodates a first absorber 104 and a second absorber 105 having different average pore sizes. The first absorber 104 is provided at the ink supply port 112, and has a smaller volume than that of the second absorber 105.

A filter 106 is provided at a distal end portion of the ink supply pipe 107. The filter 106 is in contact with the first absorber 104 in a state wherein the ink supply pipe 107 is inserted into the ink tank.

The first absorber 104 has a volume which ensures that the amount of ink retained in the first absorber 104 is between three and ten times that of the amount of ink retained in the ink flow path between a first ink absorber 104 and one or more discharge ports of the recording head. The amount of ink the ink flow path between a first ink absorber 104 and one or more discharge ports of the recording head, indicated by V, is the sum of the volume of a liquid passage 109 (if a plurality of liquid passages are provided in the head, the total of the volumes thereof), the volume of a common liquid passage 108 and the volume of the ink supply passage 107. The amount of ink retained in the first absorber 104 is indicated by the total pore volume Z (the volume of the average pore ×the number of pores per unit volume×the volume of the absorber) of the first absorber.

In order to allow the bubbles existing in the liquid passage, the common liquid passage and the ink supply passage to be removed in the recovery operation, all the inks existing in the liquid passage, the common liquid passage and the ink supply passage are discharged in a single suction operation.

Hence, the amount of ink which is equal to the sum of the volume of the liquid passage, the volume of the common liquid chamber and the volume of the ink supply passage flows in a single suction operation, necessitating at least the amount of ink equal to the amount of ink which flows in the single suction operation to be retained in the first absorber 104.

The flow of ink present near the contact portion between the first absorber 104 and the second absorber 105 cannot follow the rapid flow of ink caused by recovery, and the ink in the second absorber 105 slowly flows into the contact portion due to the capillary force of the first absorber 104. The ink in the contact portion returns to its balanced state in one minute. The portion of the absorber 105 located away from the absorber 104 requires a longer delay time. That is, it takes about ten minutes for the ink in the ink tank to returns to a balanced state after recovery. With that delay time taken into consideration, it is safe that the first absorber 104 has a capacity which enables it to retain about 3V of ink so as to enable recording to be performed immediately after a recovery operation.

Where a sequence of suction/recovery operations are executed, the first absorber must have a volume which enables it to retain the amount of ink corresponding to the number of recovery operations. However, an increase in the volume of the first absorber reduces the amount of ink accommodated in the ink tank. Also, a non-suction state exists between adjacent recovery operations in the sequence of recovery operations, for example, between the first and second recovery operations, and the ink flows into the first absorber 104 from the second absorber 105 during that time. With these factors taken into consideration, the volume of the first absorber 104 is set to a value which is equal to about 10 times of V so that reliable recovery operations can be performed without taking in air.

Because the ink in the second absorber must smoothly flow into the first absorber not only during recovery but also during recording, the average pore size of the first absorber is made smaller than that of the second absorber. A desirable average pore size of the actually employed first absorber is between 0.05 mm and 0.3 mm. The above-described average pore size ensures smooth flow of the ink from the second absorber into the first absorber and smooth flow of the ink from the first absorber into the ink supply pipe through the filter. As mentioned above, the average pore size of the second absorber is relatively larger than the above-described average pore size of the first absorber so as to assure smooth flow of the ink into the first absorber. A desirable average pore size of the second absorber is between 0.08 mm and 0.5 mm.

The present inventors conducted experiments regarding the ink supply performance during recovery and recording using

| | |
|---|---|
| First absorber: number of pores | 200 per inch |
| average pore size | 0.127 mm |
| Second absorber: number of pores | 120 per inch |
| average pore size | 0.212 mm |

A first absorber which could contain 3 V of ink (which ensures that recovery operation can be successively conducted up to three times) was used. An ink having a surface tension of 45 dyn and a wet angle of 0° was used. In the above experiments, the ink flowed without intervention, and a very excellent ink supply state could be maintained.

The following phenomenon was observed during recording.

After the ink is discharged from the liquid passage, the ink present near the filter surface of the first absorber 104 is first consumed, which is followed by consumption of the ink present near the contact surface between the first absorber 104 and the second absorber 105. Finally, the ink in the second absorber is consumed. During ink consumption, the difference between the speed at which the ink in the first absorber is consumed and the speed at which the ink in the second absorber flows into the first absorber is in proportion to the quantity of ink discharged per unit time. That is, as the amount of ink consumed per unit time increases excessively, a sufficient amount of ink may not flow from the second absorber into the first absorber, causing interruption of ink flow.

In the experiments conducted using a recording head having 128 nozzles, the quantity of ink discharged per unit time, which assured normal recording without interruption of the ink flow at a discharge rate of 80 ng per nozzle, could be increased up to 1.024 g/sec. The above-mentioned value causes no problem in an actually employed ink jet recording apparatus.

In the present invention, no gas is taken in during recovery and recording from the contact surface between the filter and the absorber. Further, since the volume of the absorber having a smaller average pore size is reduced to a minimum value, the amount of ink contained in the ink tank can be increased, and the amount of ink which can be used up from the ink tank can be increased.

Second Embodiment

Figure 2:
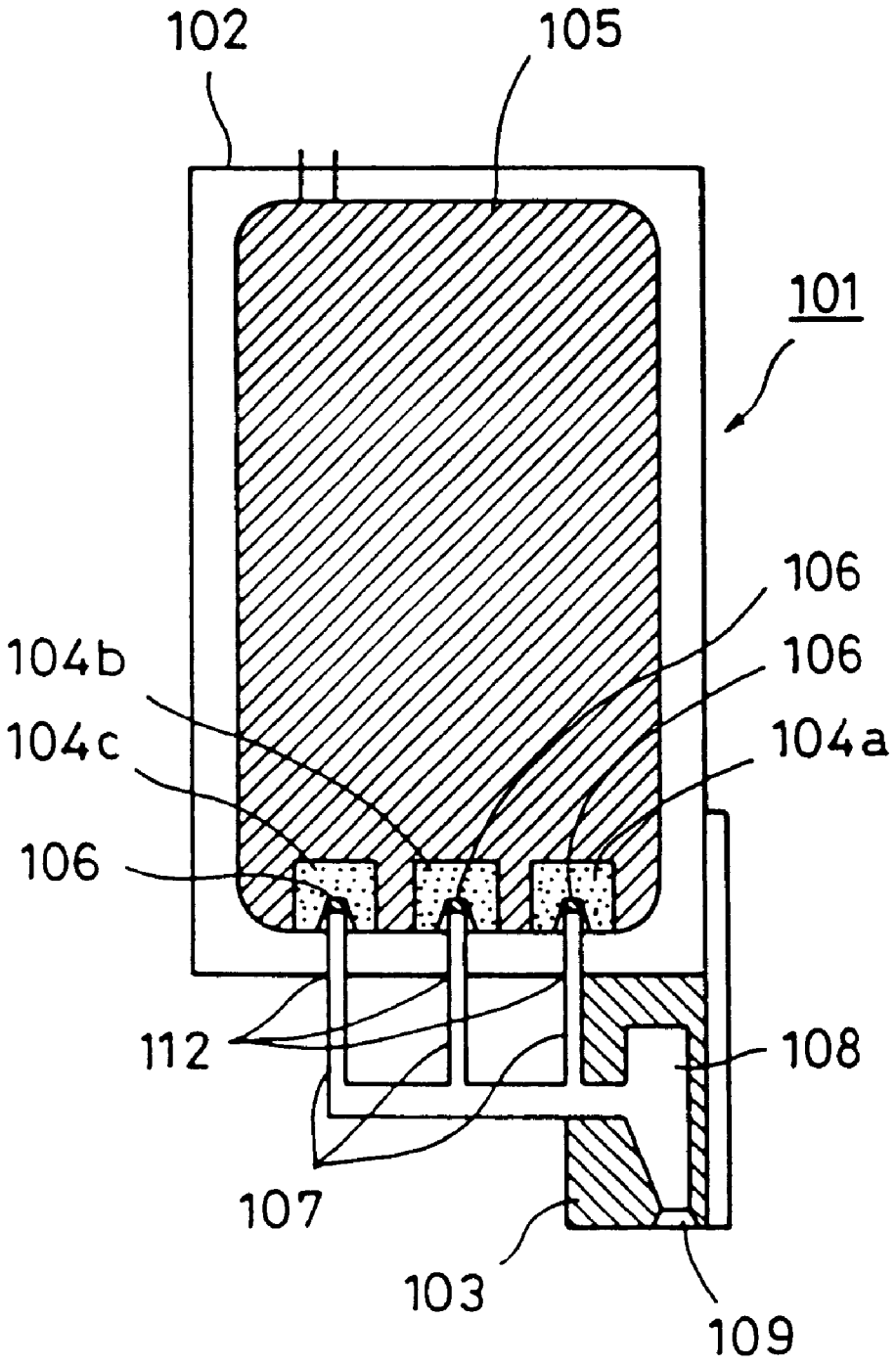
FIG. 2 is a schematic view of another embodiment of the ink jet unit according to the present invention.

FIG. 2 is a schematic cross-sectional view of a second embodiment of the ink jet head unit according to the present invention.

In the second embodiment, the first absorber employed in the first embodiment is divided into three portions. The three first absorber portions are provided in the ink tank, and three supply passages 107 for coupling the common liquid chamber 108 and the ink tank 102 and three filters 106 are accordingly provided. The three first absorber portions 104*a*, 104*b* and 104*c* are in contact with the surfaces of the respective filters 106. In this way, taking in of the gas is prevented, and the ink in the ink tank can be sufficiently used up.

The total of the volumes of the three first absorbing members 104*a*, 104*b* and 104*c* is equal to the volume of the first absorber 104 employed in the first embodiment.

This enables suction to be performed in recovery up to three times.

Assuming that one side of the first absorber 104 is X, the surface area thereof in contact with the second absorber 105 is $5X^2$. If the three sides of each of the three first absorber portions in the second embodiment are respectively X, X and 1/3X, the total of the surface areas of the three first absorber portions is $3\times(2\times X^2+3\times 1/3X\times X)=9X^2$. That is, the total of the divided first absorber portions is 9/5 times that of the first absorber 104.

In other words, when the ink retained in the first absorber portions 104*a*, 104*b* and 104*c* has been consumed, the ink in the second absorber 105 is supplied into the first absorber portions 104*a*, 104*b* and 104*c* faster than that in the first embodiment, thus increasing the quantity of ink discharged per unit time.

The present inventors actually conducted such an investigation, and found that the quantity of ink discharged per unit time which assured normal recording without interruption of the ink flow could be increased up to 1.536 g/sec.

In other words, the area of the contact portion between the first absorber 104 having a small average pore size and the second absorber 105 is almost doubled by dividing the first absorber 104 into three portions. Consequently, the speed at which the first absorber 104 is filled with the ink after suction/recovery is increased, increasing the quantity of ink supplied per unit time.

Figure 3:
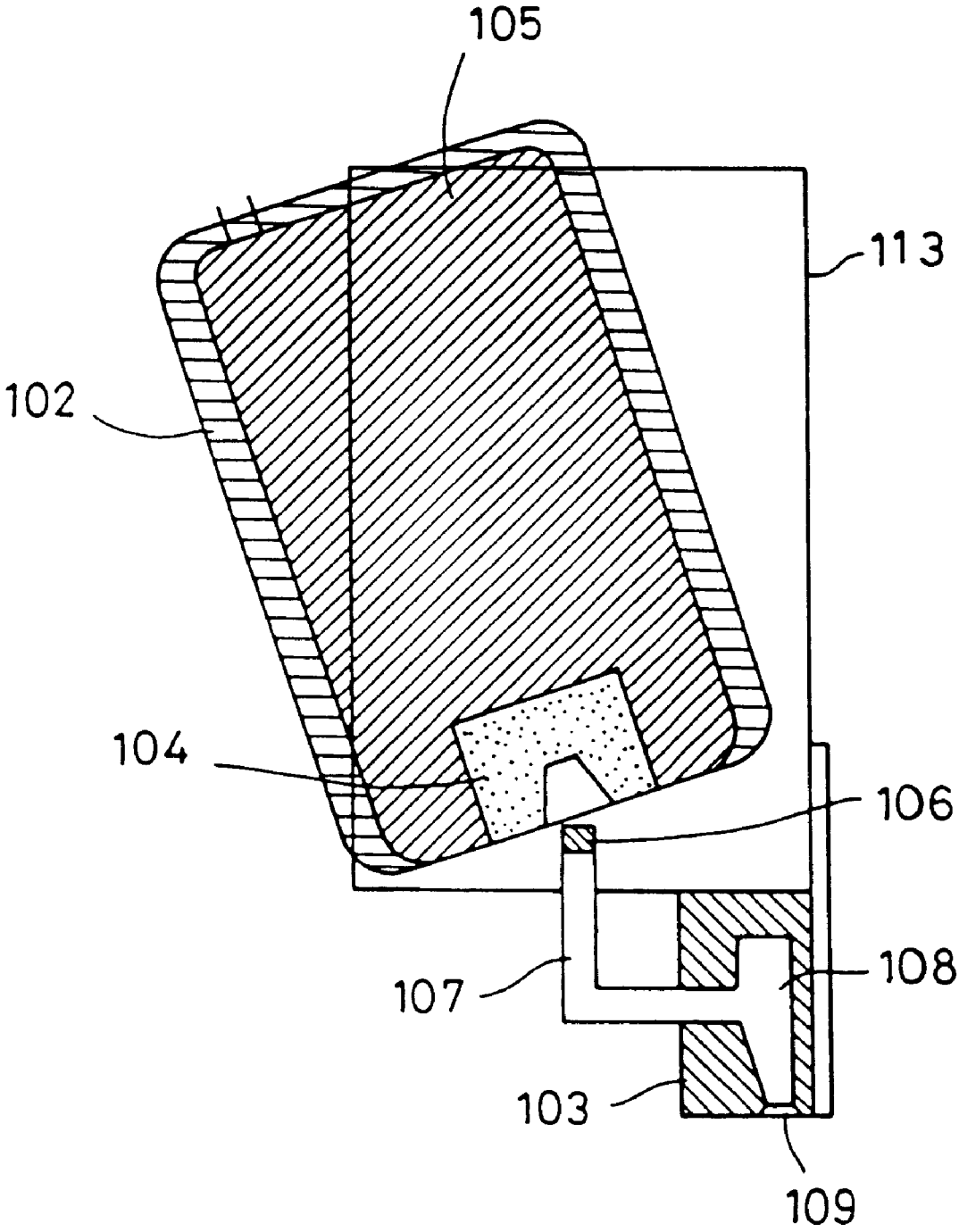
FIG. 3 is a schematic view showing how a recording head is brought into contact with and separated from an ink container in the ink jet unit according to the present invention.

FIG. 3 illustrates an example of an ink jet head unit designed such that a head portion and an ink tank portion can be separated from each other so as to make the ink tank replaceable.

An exchangeable tank 102 contains the first absorber 104 and the second absorber 105. The structure of the first absorber 104 is the same as that employed in the ink tank shown in FIG. 1. When the exchangeable tank is not mounted, the surface of the filter provided at the distal end of the supply path is exposed.

When the ink tank is replaced with a new one because the ink in the ink tank has been used up, a bubble may enter the supply passage, the liquid chamber or the liquid passage. If the suction/recovery operation is performed in that state with an ink tank to which the present invention is not applied, gas may be taken in from the contact surface between the filter and the absorber because the flow of the ink in the absorber may not follow the suction speed.

In contrast, in an exchangeable tank to which the present invention is applied, the flow of the ink in the first absorber is sufficient to follow the suction speed, and suction/recovery operation can thus be performed continuously without taking in the gas from the contact surface between the filter and the first absorber 104.

Further, since the volume of the first absorber 104 is reduced to a minimum value, the amount of ink contained in the exchangeable tank is increased, enabling the ink in the tank to be sufficiently used.

In other words, when the present invention is applied to an exchangeable tank type ink jet recording head, the running cost can further be reduced.

When the present inventors examined the ink supply property of the ink having a surface tension $\gamma$ of 10 to 100 dyn and a wet angle of 0° to 45° using the ink tank constructed in the manner described above, excellent ink supply properties could be obtained.

As will be understood from the foregoing description, in the present invention, a plurality of absorbers having different average pore sizes are placed in an ink tank, and the absorber having the smallest average pore size is disposed in contact with the filter. The average pore size R (mm) of that absorber satisfies the condition expressed by:

$0.05<R<0.3$

In this way, excellent ink supply properties are assured.

Further, if the sum of the volume of the supply passage) the volume of the common liquid chamber and the volume of the liquid passages in the recording head is V, the ink flow path between a first ink absorber and one or more discharge ports of the recording head, the total pore volume Z of the first absorber satisfies the condition expressed by:

$3\ V<R<10\ V$

In this way, it is possible to provide an ink jet recording head and a recording apparatus which enable stable ink supply during high-speed recording and which enable the running cost to be reduced.

The flow of the ink in the ink tank is affected not only by the pore size of the absorber but also by the wetting angle of the ink with respect to the absorber.

The absorber accommodated in the ink tank will now be described in terms of the ink wetting angle.

Third Embodiment

Referring to FIG. 1, two absorbers (the first absorber 104 and the second absorber 105) made of porous materials are accommodated in the ink tank. The first absorber 104 is in contact with the surface of the filter in the ink tank. The third embodiment is directed to prevention of entrance of gas from the contact surface between the filter and the first absorber which would occur during suction, and using up of a maximum amount of ink in the ink tank. Table 1 shows the structure of the first and second absorbers 104 and 105 and the properties of the ink.

| | First Absorber | Second Absorber |
|---|---|---|
| Number of Pores per Inch | 160 | 160 |
| Average Pore Size (cm) | 0.016 | 0.016 |
| Ink Density (g/cm$^3$) | 1.05 | 1.05 |
| Ink Surface Tension (dyn/cm) | 31 | 31 |
| Wetting Angle (deg) | 5 | 40 |

Generally, the capillary force of the absorber for retaining the ink in the tank varies according to the wetting angle $\theta$ of the ink with respect to the absorber or the average pore size R of the absorber. The capillary force is given by Equation (a)

$$h=2\gamma \cos\theta/(r\rho g) \quad (1)$$

where h is the capillary force (cm), γ is the surface tension (dyn/cm) of the ink, θ is the wetting angle (deg), r is the radius of the pore (cm), ρ is the density (g/cm$^3$) of the ink and g is the gravitational acceleration (cm/s$^2$).

The capillary force hi of the first absorber 104 becomes larger than the capillary force h2 of the second absorber 105 by making the wetting angle of the second absorber 105 with respect to the ink larger than the wetting angle of the first absorber 104, as shown in Table 1.

$$h1 = 2\times 31\times \cos(5)/(0.016\div 2\times 1.05\times 980) = 7.50 \text{ cm}$$

$$h2 = 2\times 31\times \cos(40)/(0.016\div 2\times 1.05\times 980) = 5.77 \text{ cm}$$

In other words, the degree of ease with which the ink exists in the first absorber 104 is larger than the degree of ease with which the ink exists in the second absorber 105 in the recording head shown in FIG. 1.

In the suction/recovery operation conducted in the ink jet unit having an ink tank exhibiting the above-described wetting property, a large pressure (a negative pressure) is instantaneously generated to suck a predetermined amount of gas and the ink while removing the bubbles attached to the wall surface of the liquid passage, the common liquid chamber or the supply passage from the wall surface.

When suction/recovery is performed in the ink jet unit shown in FIG. 1, the ink in the first absorber 104 against which the filter is pressed is taken into the supply passage, the common liquid chamber and the liquid passage. At that time, since a sufficient amount of ink is present in the first absorber 104, even if a large negative pressure is instantaneously generated, no air is taken in from the contact surface between the filter and the first absorber 104. The flow of ink in the contact portion between the first absorber 104 and the second absorber 105 cannot follow the rapid ink flow caused by recovery, and the ink in the second absorber 105 slowly flows into the contact portion due to the capillary force of the first absorber 104. The ink in the contact portion returns to its balanced state in one minute. The portion of the absorber 105 located away from the absorber 104 requires a longer delay time. That is, it takes about ten minutes for the ink in the ink tank to return to a balanced state.

After the ink is discharged from the liquid passage, the ink present near the filter surface of the first absorber 104 is first consumed, which is followed by consumption of the ink present near the contact surface between the first absorber 104 and the second absorber 105. Finally, the ink in the second absorber is consumed. During ink consumption, the difference between the speed at which the ink in the first absorber is consumed and the speed at which the ink in the second absorber flows into the first absorber is in proportion to the quantity of ink discharged per unit time. That is, as the amount of ink consumed per unit time increases, a sufficient amount of ink may not flow from the second absorber into the first absorber, causing interruption of ink flow.

In the experiments conducted using an ink jet unit in which a recording head having 128 nozzles was mounted on the ink tank exhibiting the above-described ink wetting property, the quantity of ink discharged per unit time, which assured normal recording without interruption of the ink flow at a discharge rate of 80 ng per nozzle, could be increased up to 1.024 g/sec. The above-mentioned value causes no problem in an actually employed ink jet recording apparatus.

In the present invention, no gas is taken in during recovery and recording from the contact surface between the filter and the absorber. Further, since the average pore size of the first absorber 104 is equal to the average pore size of the second absorber 105, the amount of ink contained in the ink tank is not reduced because the average pore size of the first absorber 104 is not small.

Fourth Embodiment

Figure 4:
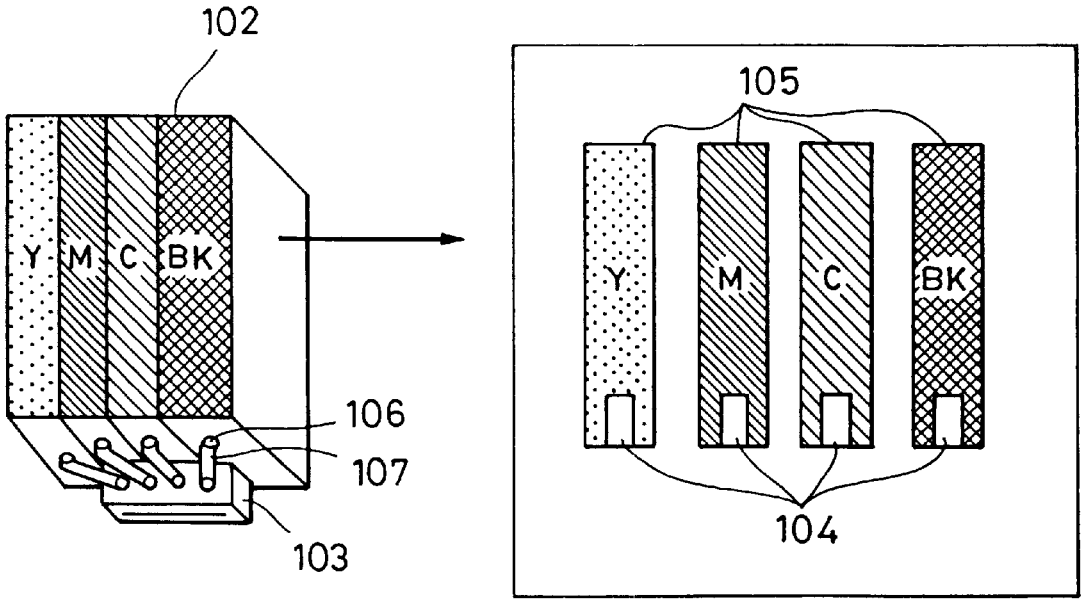
FIG. 4 is a schematic view of still another embodiment of the ink jet unit according to the present invention.

FIG. 4 is a schematic view of another embodiment of the ink jet unit to which the present invention is applied.

In this embodiment, two types of absorbers (a first absorber 104 and a second absorber 105) for each color are accommodated in an ink tank of a color head capable of recording four colors (yellow (Y), magenta (M), cyan (C) and black (BK)), and the average pore size of the first absorber 104 is optimized according to the surface tension and the wetting angle of the ink of each color. In this embodiment, a porous member is used as the absorber.

Table 2 shows the surface tension and ink density of the ink of each color and the wetting angle thereof with respect to the absorber.

TABLE 2

| | Surface Tension | Wetting Angle | Ink Density |
|---|---|---|---|
| Yellow | 32 dyn/cm | 5 deg | 1.05 g/cm$^3$ |
| Magenta | 35 | 5 | 1.05 |
| Cyan | 41 | 10 | 1.05 |
| Black | 60 | 30 | 1.10 |

The ink supply passage of the ink of each color has the following structure.

| Number of Nozzles | Discharge Port Area | Length of Supply Passage | Inner diameter of Supply Passage | Volume of Common Chamber |
|---|---|---|---|---|
| 64 | 400 um | 20 mm | 3 mm | 20 mm$^3$ |

If the number of pores and average pore size of the first absorber 104 of each of four colors are respectively 80 per inch and 0.032 mm, and if the number of pores and average pore size of the second absorber 105 of each of four colors are respectively 60 per inch and 0.042 mm, the capillary forces h1(Y), h1(M), h1(C) and h1(Bk) of the first absorbers 104 of the four colors and h2(Y), h2(M), h2(C) and h2(Bk) of the second absorbers 105 of the four colors are given as follows:

$$h1(Y) = 2\times 32\times \cos(5)/(0.016\times 1.05\times 980) = 3.87 \text{ cm}$$

$$h1(M) = 2\times 35\times \cos(5)/(0.016\times 1.05\times 980) = 4.23 \text{ cm}$$

$$h1(C) = 2\times 41\times \cos(10)/(0.016\times 1.05\times 980) = 4.90 \text{ cm}$$

$$h1(Bk) = 2\times 60\times \cos(30)/(0.016\times 1.10\times 980) = 6.03 \text{ cm}$$

$$h2(Y) = 2\times 32\times \cos(5)/(0.016\times 1.05\times 980) = 3.10 \text{ cm}$$

$$h2(M) = 2\times 35\times \cos(5)/(0.016\times 1.05\times 980) = 3.39 \text{ cm}$$

$$h2(C) = 2\times 41\times \cos(10)/(0.016\times 1.05\times 980) = 3.92 \text{ cm}$$

$$h2(Bk) = 2\times 60\times \cos(30)/(0.016\times 1.10\times 980) = 4.59 \text{ cm}$$

In the above-described recording head, the degree of ease at which bubbles are taken in from the contact surface between the filter and the first absorber 104 of each color when suction is performed on the four colors at the same time is determined by the capillary force of the first absorber 104. That is, bubbles are not readily taken in from the contact surface between the filter and the first absorber 104 of black ink having the largest capillary force, because the path of the air in the first absorber 104 lessens as the density at which the ink is retained in the first absorber 104 increases.

The amount of ink (ink gross) contained in the tank of each color depends on the average pore size of the second absorber 105 when the volume of the first absorber 104 is sufficiently smaller than that of the second absorber 105. In other words, the larger the average pore size of the second absorber 105, the more ink can be retained. As mentioned in the first embodiment, if the capillary force of the first absorber 104 is larger than the capillary force of the second absorber 105, the ink in the tank is readily retained in the first absorber 104. Therefore, the amount of ink (ink net) which can be used up depends on the capillary force of the first absorber 104.

Hence, in order to fix the capillary force of the first absorber 104 regardless of the property of the ink, the average pore size R of the first absorber 104 is made different for each color. Table 3 shows the average pore size of the first absorber 104 of each color when the capillary force h1(Bk) of the first absorber 104 for black ink, which is 6.03 cm, is set as the capillary force of the first absorber 104 for each color.

TABLE 3

| | | |
|---|---|---|
| Yellow | R(Y) | = 2 × 32 × cos(5)/(6.03 × 1.05 × 980)<br>= 0.010 × 2 = 0.020 cm |
| Magenta | R(M) | = 2 × 35 × cos(5)/(6.03 × 1.05 × 980)<br>= 0.011 × 2 = 0.022 |
| Cyan | R(C) | = 2 × 41 × cos(10)/(6.03 × 1/05 × 980)<br>= 0.013 × 2 = 0.026 cm |
| Black | R(Bk) | = 0.016 × 2 = 0.032 cm |

When suction was conducted on four colors at the same time in the above-described recording head, no bubble was taken in from the contact surface between the filter and the first absorber for each of the four colors.

As mentioned above, two absorbers are accommodated in the ink tank of each of the four colors, and the average pore size of the first absorber 104 against which the filter is pressed is made different for every color. Therefore, in an ink jet recording head which employs inks having different surface tensions and wetting angles, stable recording is enabled with no bubble taken in during suction simultaneously conducted on four colors. Further, since the ink gross and ink net can be increased to a maximum value, running cost can be reduced.

The above-described structure can be applied to an exchangeable tank type ink jet unit. In that case, taking in of the gas is restricted, and the amount of ink contained in the exchangeable tank is increased by reducing the volume of the first absorber to a minimum value, enabling the ink in the tank to be used up. That is, when the present invention is applied to the exchangeable tank type ink jet recording head, running cost is further reduced.

As will be understood from the foregoing description, in an ink tank in which a reduction in the amount of ink retained in the absorber is restricted and which retains the ink supplied to a recording head driven on the basis of a signal of recording using ink which is to be used up, the ink tank has a filter at an ink outlet portion. The ink tank further has a first absorber accommodated in contact with the filter and a second absorber accommodated in contact with the first absorber. The wetting angles $\eta 1$ and $\theta 2$ of the first and second absorbers satisfy the following conditions:

$\cos \theta 1 > \cos \theta 2$

In an ink tank which accommodates a plurality of inks to be respectively supplied to a plurality of recording heads driven on the basis of a recording signal, each of the ink tanks has a filter at an ink outlet portion. The ink tank also has a first absorber having an average pore size selected according to the surface tension of each of the inks, and a second absorber having an average pore size different from that of the first absorber. The first absorber is accommodated in contact with the filter, and the second absorber is accommodated in contact with the first absorber.

A reduction in the amount of ink retained in the absorber is achieved, and the amount of ink which can be used up is increased to a maximum value. Further, taking in of gas during suction/recovery is prevented, and the amount of ink of each color can be reduced to a minimum value. Consequently, the running cost of the ink jet recording head can be reduced.

What is claimed is:

1. An ink container for containing ink for supply to a recording head, the recording head having plural discharge ports each having a liquid passage, a liquid chamber common to the plural liquid passages, and an ink supply pipe for supplying ink to the common liquid chamber, said ink container being attachably and detachably mountable to the recording head and usable in an ink let apparatus having a recovery structure for sucking ink from the plural liquid passages so as to recover ink discharge of the recording head, said ink container comprising:

an opening in said ink container for supplying ink to the ink supply pipe of the recording head;

a first ink absorber located in said ink container adjacent said opening, wherein a volume Z of said first ink absorber and a total volume V of the ink supply pipe, the common liquid chamber and the plural liquid passages, have a relationship expressed by $3\ V<Z<10\ V$; and a second ink absorber, said second ink absorber being located in said ink container adjacent said first ink absorber and not adjacent said opening.

2. The ink container according to claim 1, wherein an average pore size R of said first ink absorber is $0.05<R<0.3$ mm, and is relatively smaller than an average pore size of said second ink absorber.

3. The ink container according to claim 1, wherein a wetting angle $\theta 1$ of said first ink absorber with respect to the ink and a wetting angle $\theta 2$ of said second ink absorber with respect to the ink have a relationship expressed by $\cos \theta 1 > \cos \theta 2$.

4. The ink container according to claim 1, wherein an average pore size R of said first ink absorber is $0.05<R<0.3$ mm, and a wetting angle $\theta 1$ of said first ink absorber with respect to the ink and a wetting angle $\theta 2$ of said second ink absorber with respect to the ink have a relationship expressed by $\cos \theta 1 > \cos \theta 2$.

5. The ink container according to claim 1, wherein the recording head and said ink container are mountable on a carriage of the ink let apparatus as one unit.

6. The ink container according to claim 5, wherein the recording head and said ink container are constituted as one unit.

7. The ink container according to claim 5, wherein the recording head is separable from said ink container.

8. An ink jet unit attachable and detachably mountable to an ink let apparatus having a recovery structure for sucking ink, said ink let unit comprising:

a recording head having plural discharge ports each having a liquid passage, a liquid chamber common to said plural liquid passages, and an ink supply pipe for supplying ink to said common liquid chamber, wherein the recovery structure of the ink jet apparatus is constructed to suck ink from said plural liquid passages so as to recover ink discharge of said recording head; and an ink container for containing ink for supply to said recording head, said ink container comprising an opening in said ink container for supplying ink to the ink supply pipe of said recording head; a first ink absorber located in said ink container adjacent said opening, wherein a volume Z of said first ink absorber and a total volume V of the ink supply pipe, the common liquid chamber and the plural liquid passages, have a relationship expressed by 3 V<Z<10 V; and a second ink absorber, said second ink absorber being located in said ink container adjacent said first ink absorber and not adjacent said opening.

9. The ink jet unit according to claim 8, wherein an average pore size R of said first ink absorber is 0.05<R<0.3 mm and is relatively smaller than an average pore size of said second ink absorber.

10. The ink jet unit according to claim 8, wherein a wetting angle θ1 of said first ink absorber with respect to the ink and a wetting angle θ2 of said second ink absorber with respect to the ink have a relationship expressed by cos θ1>cos θ2.

11. The ink jet unit according to claim 8, wherein an average pore size R of said first ink absorber is 0.05<R<0.3 mm, and a wetting angle θ1 of said first ink absorber with respect to the ink and a wetting angle θ2 of said second ink absorber with respect to the ink have a relationship expressed by cos θ1>cos θ2.

12. The ink jet unit according to claim 8, wherein said recording head and said ink container are mountable on a carriage of the ink let apparatus as one unit.

13. The ink jet unit according to claim 12, wherein said recording head and said ink container are constituted as one unit.

14. The ink jet unit according to claim 12, wherein said recording head is separable from said ink container.

15. An ink jet apparatus comprising:

a recording head having plural discharge ports each having a liquid passage, a liquid chamber common to said plural liquid passages, and an ink supply pipe for supplying ink to said common liquid chamber;

a recovery structure for sucking ink from said plural liquid passages of said recording head, so as to recover ink discharge of said recording head;

an ink container attachable and detachably mountable to said recording head; and a carriage on which said recording head and said ink container are mountable as one unit for scanning motion across a recording medium;

wherein said ink container comprises:

an opening in said ink container for supplying ink to the ink supply pipe of the recording head; a first ink absorber located in said ink container adjacent said opening, wherein a volume Z of said first ink absorber and a total volume V of the ink supply pipe, the common liquid chamber and the plural passages, have a relationship expressed by 3 V<Z<10 V; and a second ink absorber, said second ink absorber being located in said ink container adjacent said first ink absorber and not adjacent said opening.

16. The ink jet apparatus according to claim 15, wherein an average pore size R of said first ink absorber is 0.05<R<0.3 mm and is relatively smaller than an average pore size of said second ink absorber.

17. The ink jet apparatus according to claim 15, wherein a wetting angle θ1 of said first ink absorber with respect to the ink and a wetting angle θ2 of said second ink absorber with respect to the ink have a relationship expressed by cos θ1>cos θ2.

18. The ink jet apparatus according to claim 15, wherein an average pore size R of said first ink absorber is 0.05<R<0.3 mm, and a wetting angle θ1 of said first ink absorber with respect to the ink and a wetting angle θ2 of said second ink absorber with respect to the ink have a relationship expressed by cos θ1>cos θ2.

19. The ink jet apparatus according to claim 15, wherein said recording head and said ink container are constituted as one unit.

20. The ink jet apparatus according to claim 15, wherein said recording head is separable from said ink container.

21. The ink container according to claim 1, wherein said ink container comprises a plurality of said first ink absorbers and a plurality of said openings in said ink container, each said opening supplying ink to a single recording head through a plurality of ink supply pipes connected respectively to said openings, wherein Z is equal to a total volume of said plurality of first ink absorbers and wherein V is equal to a total volume of the plurality of ink supply pipes plus the common liquid chamber and the plural liquid passages.

22. the ink jet unit according to claim 8, wherein said ink container comprises a plurality of said first ink absorbers and a plurality of said openings in the said container, each said opening for supplying ink to a single recording head through a plurality of ink supply pipes connected respectively to said openings, wherein Z is equal to a total volume of said plurality of first ink absorbers and wherein V is equal to a total volume of said plurality of ink supply pipes plus said common liquid chamber and said plural liquid passages.

23. An ink jet apparatus according to claim 15, wherein said ink container comprises a plurality of said first absorbers and a plurality of said openings in said ink container, each said opening for supplying ink to a single recording head through a plurality of ink supply pipes connected respectively to said openings, wherein Z is equal to a total volume of said plurality of first ink absorbers and wherein V is equal to the total volume of said plurality of ink supply passages.

* * * * *

UNITED STATES PATENT AND TRADEMARK OFFICE

CERTIFICATE OF CORRECTION

PATENT NO. : 6,015,210

DATED : January 18, 2000

INVENTORS : DAIGORO KANEMATSU, et al.

It is certified that error appears in the above-identified patent and that said Letters Patent is hereby corrected as shown below:

COLUMN 1

Line 16, "in" should read --on--.
Line 17, "in" should read --on--.
Line 29, "the" should be deleted.

COLUMN 2

Line 59, "FIG. 1a" should read --FIG. 1 is a--.

COLUMN 3

Line 11, "is" should read --is a--; and "detail" should read --details--.

COLUMN 4

Line 24, "id" should read --1d--.
Line 60, "(Mi" should read --(M1--.

COLUMN 5

Line 65, "returns" should read --return--.

UNITED STATES PATENT AND TRADEMARK OFFICE

CERTIFICATE OF CORRECTION

PATENT NO. : 6,015,210

DATED : January 18, 2000

INVENTORS : DAIGORO KANEMATSU, et al.

It is certified that error appears in the above-identified patent and that said Letters Patent is hereby corrected as shown below:

COLUMN 8

Line 27, "passage)" should read --passage,--.
Line 28, "volume" should read --volumes--.
Line 33, "3V<R<10V" should read --3V<Z<10V--.

COLUMN 9

Line 6, "hi" should read --h1--.

COLUMN 10

Line 57, "(0.016" should read --(0.021--.
Line 58, "(0.016" should read --(0.021--.
Line 60, "(0.016" should read --(0.021--.
Line 62, "(0.016" should read --(0.021--.

COLUMN 12

Line 2, "η1" should read --θ1--.

UNITED STATES PATENT AND TRADEMARK OFFICE

CERTIFICATE OF CORRECTION

PATENT NO. : 6,015,210

DATED : January 18, 2000

INVENTORS : DAIGORO KANEMATSU, et al.

It is certified that error appears in the above-identified patent and that said Letters Patent is hereby corrected as shown below:

COLUMN 12

Line 27, "let" should read --jet--.
Line 59, "let" should read --jet--.
Line 65, "attachable" should read --attachably--.
Line 66, "let" should read --jet--.
Line 67, "let" should read --jet--.

COLUMN 13

Line 37, "let" should read --jet--.
Line 52, "attachable" should read --attachably--.

COLUMN 14

Line 40, "the" should read --The--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*